US009536418B2

(12) United States Patent
Mao et al.

(10) Patent No.: US 9,536,418 B2
(45) Date of Patent: Jan. 3, 2017

(54) INDUSTRIAL FIELD REAL-TIME WORKING CONDITION RADIO ALARM SYSTEM

(75) Inventors: Fei Mao, Heilongjiang (CN); Weigang Wang, Heilongjiang (CN); Xuannan Li, Heilongjiang (CN); Jilong Liu, Heilongjiang (CN)

(73) Assignee: Harbin East Alarm Equipment Development Co., Ltd., Harbin, Heilongjiang (CN)

( * ) Notice: Subject to any disclaimer, the term of this patent is extended or adjusted under 35 U.S.C. 154(b) by 424 days.

(21) Appl. No.: 13/877,189

(22) PCT Filed: Mar. 9, 2012

(86) PCT No.: PCT/CN2012/072134

§ 371 (c)(1),
(2), (4) Date: May 5, 2014

(87) PCT Pub. No.: WO2013/029363

PCT Pub. Date: Mar. 7, 2013

(65) Prior Publication Data

US 2014/0240120 A1 Aug. 28, 2014

(30) Foreign Application Priority Data

Sep. 1, 2011 (CN) ..... 2011 1 0256389

(51) Int. Cl.
*G08B 1/08* (2006.01)
*G08B 25/10* (2006.01)
(Continued)

(52) U.S. Cl.
CPC ..... *G08B 25/10* (2013.01); *G08B 25/016* (2013.01); *G08B 27/008* (2013.01); *G08B 21/12* (2013.01)

(58) Field of Classification Search
CPC ..... G08B 25/10; G08B 25/016; G08B 21/02
(Continued)

(56) References Cited

U.S. PATENT DOCUMENTS 5,867,105 A * 2/1999 Hajel ..... G08B 6/00 340/407.1
6,329,924 B1 * 12/2001 McNulty ..... G01R 29/0857 340/552
(Continued)

FOREIGN PATENT DOCUMENTS

CN 201202462 Y 3/2009
CN 201339487 Y 11/2009
(Continued)

OTHER PUBLICATIONS

International Search Report issued by State Intellectual Property Office of the P.R. China in connection with International Patent Application No. PCT/CN2012/072134. Dated Jun. 14, 2012. 3 pages.

*Primary Examiner* — Kerri McNally
*Assistant Examiner* — Sharmin Akhter
(74) *Attorney, Agent, or Firm* — Hamre, Schumann, Mueller & Larson, P.C.

(57) ABSTRACT

An industrial field real-time working condition radio alarm system, comprises a transmitting end (11) and a receiving end (12) carried a worker; the transmitting end (11) comprises a detector (101) to detect the current working condition, a transmitting end processor (102) to process an on-off signal sent by the detector (101), and a radio transmitter (103) to transmit an alarm signal to the receiving end (12) under the control of the transmitting end processor (102); the receiving end (12) comprises a radio receiver (105) to receive the alarm signal, a receiving end processor (106) to process the alarm signal sent by the radio receiver (105), and an alarm (107) to send an alarm under the control of the receiving end processor (106); the transmitting end proces-
(Continued)

sor (102) is connected to the detector (101) and the radio transmitter (103) respectively; and the receiving end processor (106) is connected to the radio receiver (105) and the alarm (107) respectively. The radio alarm system can send a dangerous working condition alarm to all workers in real time.

21 Claims, 4 Drawing Sheets

(51) Int. Cl.
*G08B 25/01* (2006.01)
*G08B 27/00* (2006.01)
*G08B 21/12* (2006.01)

(58) Field of Classification Search
USPC ..... 340/10.1–10.6, 539.1–539.17, 539.22, 340/539.26, 573.1, 577, 602, 604, 340/627–634; 379/37, 38, 52; 361/170
See application file for complete search history.

(56) References Cited

U.S. PATENT DOCUMENTS

2006/0226973 A1* 10/2006 Catlin ..... G08B 17/10 340/539.11
2008/0136655 A1* 6/2008 Ho ..... H02J 7/0029 340/664

FOREIGN PATENT DOCUMENTS

| | | | |
|---|---|---|---|
| CN | 201489652 | U | 5/2010 |
| CN | 201522764 | U | 7/2010 |
| CN | 201852600 | U | 6/2011 |
| CN | 201853309 | U | 6/2011 |
| CN | 202221615 | U | 5/2012 |
| FR | 2582429 | A1 | 11/1986 |
| JP | 2007-013868 | A | 9/2008 |
| WO | WO 2006/116800 | A1 | 11/2006 |

* cited by examiner

INDUSTRIAL FIELD REAL-TIME WORKING CONDITION RADIO ALARM SYSTEM

FIELD OF INVENTION

The invention relates to industrial field real-time working condition alarm technology, in particularly, to an industrial field real-time working condition radio alarm system.

BACKGROUND OF THE INVENTION

Usually, plants and mines which dangers might occur in operation will be equipped with certain amounts of real-time working condition alarm systems, in order to detect dangerous conditions and alarm in time, thus to guarantee the life and safety of workers.

In prior art, fixed or handheld detectors are assumed to detect dangerous conditions (such as dangerous gas, high pressure environment, high temperature environment etc.), when danger occurs, the detector will sent an alarm signal to a remote control centre, then the control centre will send an alarm, for example, the control centre may warning workers through ringing bells, initiating warning lamps and other means, thus the workers may evacuate in time.

It can seen that, in the prior art real-time working condition alarm system, the control centre is situated at the central position, when dangers are detected, the one which get the alarm signal first is control centre, thus the workers will be evacuated only after receiving the alarm from control centre. If the control centre failures or the reaction speed is too slow, it will badly affect the evacuation as well as the life and safety of workers. In addition, bells, warning lamps and other devices used to indicate alarm from control centre are usually disposed at a specific position in the plants, the workers who are closer to the position may quickly alerted to evacuate in time, but the worker who far away from the position might not be able to evacuate because of not receiving the alarm in time.

SUMMARY OF THE INVENTION

According to one aspect of the invention, the invention provides an industrial field real-time working condition radio alarm system, the system comprises a transmitting end and a receiving end carried by workers; said transmitting end comprises: a detector to detect the current working condition, a transmitting end processor to process an on-off signal sent by said detector, and a radio transmitter to transmit an alarm signal to said receiving end under the control of said transmitting end processor; said receiving end comprises: a radio receiver to receive said alarm signal, a receiving end processor to process said alarm signal sent by said radio receiver, and an alarm to send an alarm signal under the control of said receiving end processor; said transmitting end processor is connected to said detector and said radio transmitter respectively; and said receiving end processor is connected to said radio receiver and said alarm respectively.

According to another aspect of the invention, the invention provides a real-time alarm system, said alarm system comprises: a detecting device to detect whether the current working condition is abnormal or not, and generating relevant signals; a transmitting device to transmit said relevant signals; and a portable receiving devices to receive said relevant signal sent by said transmitting devices and send an alarm signal.

According to another aspect of the invention, the invention provides a real-time alarm method, said method comprises: detecting whether the current working condition is abnormal or not; generating a relevant signal when the current working condition is abnormal; transmitting said relevant signal; receiving said relevant signal through a portable receiving device; sending an alarm signal when receiving said relevant signal.

DETAILED DESCRIPTION

The principles and characteristics of present invention will now be described, with reference to the accompanying drawings. The embodiments are only to explain the invention, but not to limit the scope of the invention.

Figure 1:
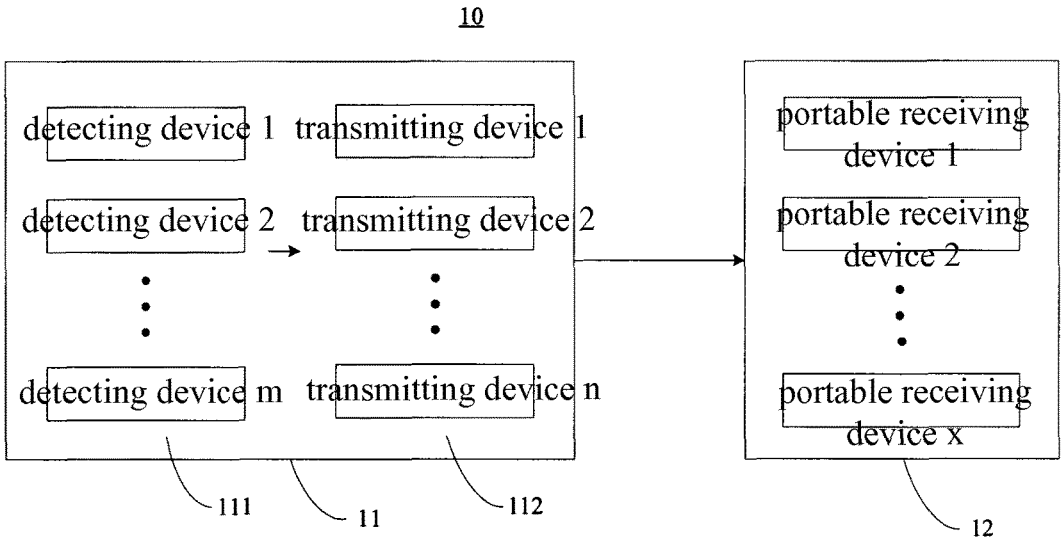
FIG. 1 is the schematic diagram of the real-time alarm system according to an embodiment of the invention.

FIG. 1 shows the schematic diagram of the real-time alarm system 10 according to an embodiment of the invention. In FIG. 1, the detecting devices 1, . . . , m (m>1) detect whether the current working condition is abnormal or not, and when abnormal working condition occurs, relevant signals are generated. The transmitting devices 1, . . . , n (n>1) transmit the relevant signals generated by the detecting devices 1, . . . , m. The portable receiving devices 1, . . . , x (x>1) receive the relevant signal sent by the transmitting devices 1, . . . , n to send an alarm signal.

According to one embodiment of the invention, transmitting devices 1, . . . , n may transmit the relevant signal in a variety of suitable wireless way, and the portable receiving devices 1, . . . , x may receive the radio signal sent by the transmitting devices 1, . . . , n.

According to one embodiment of the invention, the detecting devices 1, . . . , m may comprise sensing unit and processing unit, wherein, the sensing unit detects whether the current working condition is abnormal or not, and if abnormal working condition occurs, a signal relevant with the abnormal working condition is generated; the process unit process the signal which generated by the sensing unit and relevant with the abnormal working condition, thus generate a relevant signal which will be transmitted to the portable receiving devices 1, . . . , x.

According to one embodiment of the invention, for the sensing unit, the person skill in the art may choose a suitable sensor according to the need of the detection, such as a temperature sensor, a pressure sensor or gas sensor or the like, or choose a combination of a number of sensors. For example, when the current working condition is high temperature, a temperature sensor may be used; and when the current working condition is high pressure environment, a pressure sensor may be used; when the current working condition is leaked dangerous gas, a fixed gas transducer or a portable gas detector may be adopted.

According to one embodiment of the invention, the person skill in the art may design a portable receiving device by him, or may use the exit device to realize the portable receiving device, such as mobile phone, personal computer or personal digital assistant (PDA) and the like.

According to one embodiment of the invention, the person skill in the art may choose suitable alarm unit according to the actual need of design, such as audible alarm, visible alarm or vibration alarm and the like.

According to one embodiment of the invention, the detecting devices 1, . . . , m and transmitting devices 1, . . . , n may be used as the transmitting end 11 of the alarm system, and the portable receiving devices 1, . . . , x may be used as the receiving end 12 of the alarm system The detail structure of the transmitting end 11 and the receiving end 12 will be described in detail in the following.

Figure 2:
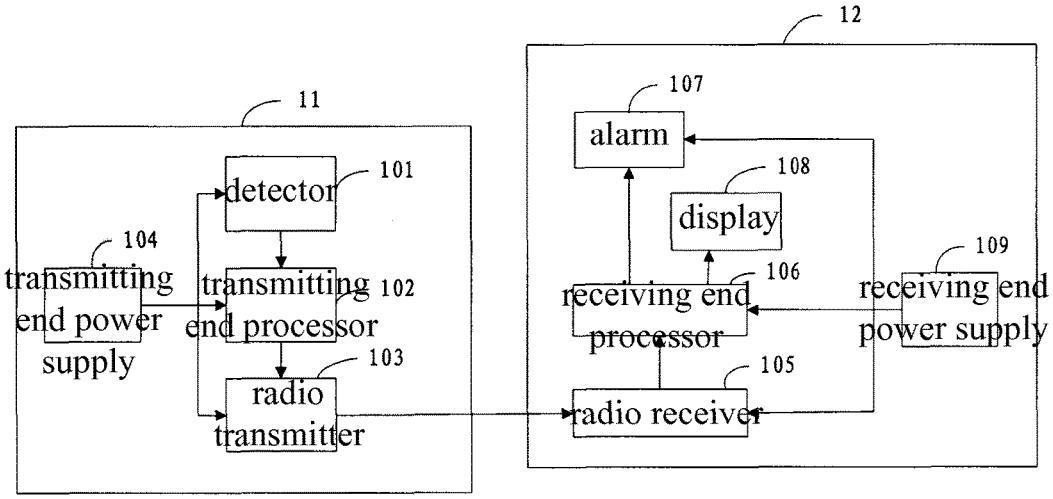
FIG. 2 is the structural view of the industrial field real-time working condition radio alarm system according to an embodiment of the invention.

FIG. 2 is the structural view of an industrial field current working condition radio alarm system according to an embodiment of the invention.

As shown in FIG. 2, the system comprises a transmitting end 11 and a portable receiving end 12, such as receiving end which may be carried by workers. Although there are only one transmitting end 11 and one receiving end 12 in the FIG. 2, the amount of the transmitting end 11 and the receiving end 12 may more than one, further, the transmitting ends 11 and the receiving ends 12 can communicate with each other through radio.

The transmitting end 11 may be located at the place where a danger is likely to be happened, also, it may be carried by some workers, thus to detect the current working condition of the plants and mines and detect dangerous conditions in time. Every worker who works at a place where dangerous conditions might occur can carry a receiving end 12 with him, thus receives an alarm signal sent in real-time by the transmitting end 11 in time, and evacuates in time when dangerous condition happened.

According to one embodiment of the invention, the transmitting end 11 comprises: a detector 101 to detect the current working condition, a transmitting end processor 102 to process an on-off signal sent by the detector 101, and a radio transmitter 103 to transmit an alarm signal to the receiving end under the control of the transmitting end processor 102. the receiving end 12 comprises: a radio receiver 105 to receive the alarm signal, a receiving end processor 106 to process the alarm signal sent by the radio receiver 105, an alarm 107 to send an alarm under the control of the receiving end processor 106. The transmitting end processor 102 is connected to the detector 101 and the radio transmitter 103 respectively. The receiving end processor 106 is connected to the radio receiver 105 and the alarm 107 respectively.

According to one embodiment of the invention, in the real-time working condition radio alarm system, the detector 101 may has many forms according to different dangerous conditions to be detected. For example, when the dangerous condition is high temperature, the detector 101 may be assumed as a temperature sensor; when the dangerous condition is high pressure, the detector 101 may be assumed as a pressure sensor; when the dangerous condition is dangerous gases leaking out, the detector 101 may be assumed as a fixed gas transducer or a portable gas detector.

When the detector 101 detected dangerous conditions, it will send a on-off signal to the transmitting end processor 102, the transmitting end processor 102 then processes the on-off signal, and produces an alarm signal. According to one embodiment of the invention, the procedure of the process may comprise: analog-to-digital conversion processing, the encryption processing and other processing. According to one embodiment of the invention, the transmitting end processor 102 may be realized by a microprocessor and peripheral circuits.

The radio transmitter 103 may conclude a antenna, a modulator, and a power amplifier. The modulator is connected to the transmitting end processor 102 to modulate the alarm signal sent by the transmitting end. The power amplifier is connected to output of the modulator to amplify the alarm signal which has been modulated. Then the signal which has been amplified is output through the antenna.

According to one embodiment of the invention, as shown in FIG. 2, the transmitting end 11 may further comprises a transmitting end power supply 104 to energize the detector 101, the transmitting end processor 102, and the radio transmitter 103. This will be described in detail in the following.

The transmitting end 11 is always in hazardous environment, and thus can be provided in a explosion-proof housing which has gas permeability, so that when dangerous condition happened, it can ensures the security of each part of the transmitting end 11 The explosion-proof housing can for example be made of aluminum alloy, stainless steel and other materials, in order to ensure that in explosion dangerous condition, its internal circuit apparatus will not be damaged. The detector 101 may be used to detect the current working condition by utilizing the gas permeability of the explosion-proof housing. Of course, in order to ensure that each portion of the transmitting end 11 work normally, the circuit may be designed to be intrinsically safe.

The radio receiver 105 receives an alarm signal sent by the radio transmitter 103 and sends it to the receiving end processor 106. As to the modulation processing to the alarm signal performed by the radio transmitter 103, the radio receiver 105 needs to demodulate the received alarm signal corresponding to the above-described modulation processing. For example, if the radio transmitter 103 carries out a QPSK modulation to the alarm signal, the radio receiver 105 should carries a QPSK demodulation to the received alarm signal, and if the radio transmitter 103 carries out a 2PSK modulation to the alarm signal, the radio receiver 105 should carries out a 2PSK demodulation to the received alarm signal.

According to one embodiment of the invention, because the alarm signal is mixed with a certain amount of noise and loses a certain amount of power during transmission, the radio receiver 105 may further includes a filter and a power amplifier. Thus, the radio receiver 105 may comprise: a receiving antenna, a filter, a demodulator, and a power amplifier. The receiving antenna is connected with the filter. The filter will transmit the alarm signal having been filtered to the connected demodulator. The demodulator then sends the demodulated signal to the power amplifier. Thus, the alarm signal being amplified by the power amplifier can be sent to the receiving end processor 106.

The receiving end processor 106 processes the received signal, and controls the alarm 107 to send an alarm when it judges that the signal is an alarm signal. The receiving end processor 106 can be assumed as a microprocessor or other circuits. According to one embodiment of the invention, if the transmitting end processor 102 encrypts the on-off signal, then the receiving end processor 106 needs to decrypts the received signal, and the decryption processing being correspond to the above-mentioned encryption processing. For example, if the encryption processing is an encryption processing using a symmetric encryption algorithm, the decryption processing then uses a encryption key which is the same with the one using in the encryption processing to decrypt. If the encryption processing is an encryption processing using a public key of the asymmetric encryption algorithm, the decryption processing then uses a private key corresponding to the public key to decrypt. The implementation of the decryption process can assume a special decryption circuit; also can be achieved by software. Furthermore, the receiving end processor 106 also can realize the analog to digital conversion of the received signal.

In order to ensure every portion of the receiving end 12 working in hazardous work environments properly, the circuit can be designed as intrinsically safe type.

According to one embodiment of the invention, as shown in FIG. 2, the receiving end 12 may further includes a receiving end power supply 109 which is used to energize the radio receiver 105, the receiving end processor 106, and the alarm 107. This will be described in detail in the following.

According to one embodiment of the invention, the receiving end 12 in FIG. 1 may further includes a display 108 connected to the receiving end processor 106, which may provides in real-time to the workers with the current signal strength, the residual quantity of the power supply 109 of the receiving end, current time and other information and also can display alarm information in text format. The display 108 can be assumed as LCD screen.

According to one embodiment of the invention, the receiving end 12 may further includes input devices connected to the receiving end processor 106, such as a keyboard, a special key, so as to receive the input instructions, thereby the receiving end processor 106 can adjusts its clock, selects alarm mode of alarm 107, the volume of alarm, the brightness of display 108, and so on according to the input command.

Thus, in the present invention, after a dangerous condition being detected by the detector, the detector sends in real-time an on-off signal to the transmitting end processor, the transmitting end processor then processes the on-off signal immediately, and an alarm signal is sent to the receiving terminals carried by workers through the radio transmitter. The alarm signal is analyzed and processed by the receiving end processor after the alarm signal being received by the radio receiver of the receiving end, which can immediately control the alarm to alert to the workers. The alarm is automatically performed in real-time, without any intermediary transit, and thus the reaction speed is very fast. Through the present invention, a certain number of the transmitting ends can be disposed at the workplace where dangerous conditions might occur, and each of the workers is equipped with a receiving terminal, so as to guarantee that an alarm can be issued to all workers in real-time when dangerous condition occurs, thus to guarantee the life and safety of all workers.

Figure 3:
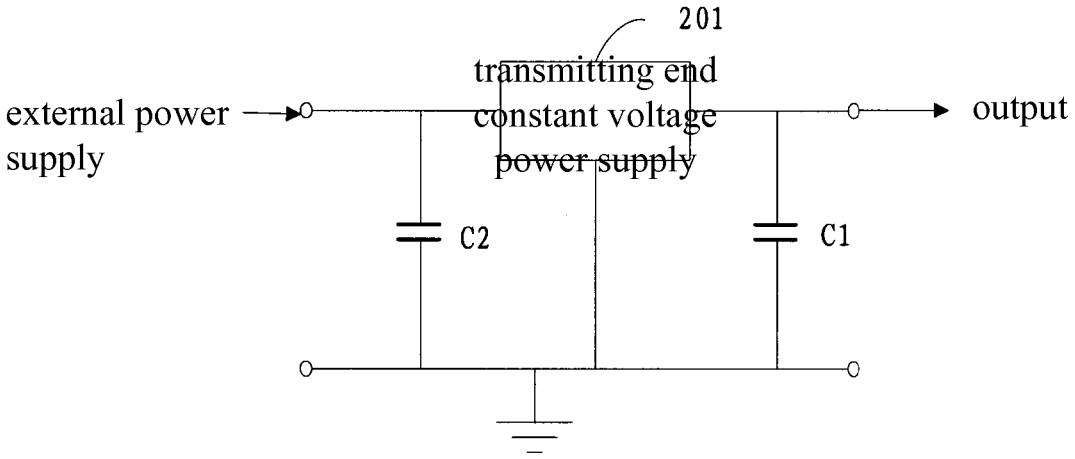
FIG. 3 is the structural view of a transmitting end power supply according to an embodiment of the invention.

FIG. 3 shows a structure of an embodiment of the transmitting end power supply 104.

As shown in FIG. 3, the transmitting end power supply 104 comprises: a first rectifier filter capacitor C1, a second rectifier filter capacitor C2, a transmitting end constant voltage power supply 201 which outputs a constant DC voltage.

Both ends of the rectifier filter capacitor C2 are connected to an external power supply and the ground respectively, the external power supply can be battery or utility power supply. The second rectifier filter capacitor C2 is used to rectify and filter the input voltage of the external power supply, and the voltage having been rectified and filtered is sent to the transmitting end constant voltage power supply 201.

The input terminal of the transmitting end constant voltage power supply 201 is connected to the external power supply, and thus connected to the second rectifier filter capacitor C2. The input voltage of input terminal is said voltage having been rectified and filtered by the second rectifier filter capacitor C2.

As shown in FIG. 3, both ends of the first rectifier filter capacitor C1 are connected to the output terminal of the transmitting end constant voltage power supply 201 and the ground respectively, for rectifying and filtering the output voltage of the transmitting end constant voltage power supply 201.

The function of the transmitting end constant voltage power supply 201 is to convert the input voltage into a constant DC voltage with a predetermined value, with the extra power being consumed in form of heat. The output signal of the output terminal of the transmitting end constant voltage power supply 201 is a constant DC voltage with a predetermined value. The output terminal is the output terminal of the transmitting end power supply 104 of the present invention, and it may energize the detector 101, the transmitting end processor 102, and the radio transmitter 103.

Of course, the transmitting end constant voltage power supply 201 also has a ground terminal, which is connected with the ground.

Figure 4:
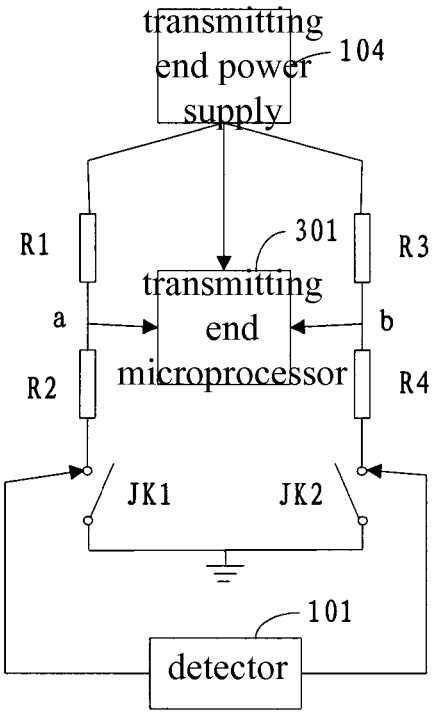
FIG. 4 is the structural view of a transmitting end processor according to an embodiment of the invention.

FIG. 4 is the structural view of transmitting end processor of the invention.

According to one embodiment of the invention, as shown in FIG. 4, the transmitting end processor includes: a transmitting end microprocessor 301, a first divider resistor R1, a second divider resistor R2, and a first controlled switch JK1. Wherein, the first controlled switch JK1 is opened and closed under the control of the detector 101. When the detector 101 detected a dangerous condition, the first controlled switch JK1 will be closed under control. When the detector 101 didn't detect a dangerous condition, the first controlled switch JK1 will be opened under control. The first divider resistor R1 has a first end and a second end, and the second divider resistor R2 has a third end and a fourth end.

As shown in FIG. 4, divider resistor R1 and a second divider resistor R2 are connected to each other in series, as well as the second end and the third end connected to each other, and the connection point a (i.e. the second end and the third end) is connected to the signal input terminal of the transmitting end microprocessor 301. Thus, the voltage of point a can be used as input signal input to the transmitting end microprocessor 301.

Both ends of the first controlled switch JK1 are connected to the fourth end and the ground respectively, and when the detector 101 detected the dangerous condition, it controls the first controlled switch JK1 to be closed. In this case, the fourth end communicates with the ground, a point is in the low level state, the transmitting end microprocessor 301 may judges that dangerous condition occurred according to the voltage at the point a, and thus can generate an alarm signal provided to the radio transmitter 103, and then an alarm signal is sent to the receiving terminals by the radio transmitter. When the detector 101 detects no dangerous condition, it controls the first controlled switch JK1 to be opened. In this case, the fourth end does not communicate with the ground, a point is in the high level state, the transmitting end microprocessor 301 then may judges that there is no dangerous condition occurred based on the voltage at the point a, and thus does not generate any alarm signal.

Both of the voltage input terminal of the transmitting end microprocessor 301 and the first end are connected to the output terminal of the transmitting end power supply 104; the output terminal of the transmitting end power supply 104 may be used as output terminal of the transmitting end constant voltage power supply 201 of FIG. 3.

Detector 101 may have a plurality of detection accuracy and detection contents, and accordingly, the transmitting end processor 102 may sends a variety of alarm signals to each receiving end 12 through the radio transmitter 103, each alarm signal corresponding to a detection content or a detection accuracy. For example, when the dangerous working condition is that the dangerous gas leaking out, the detector 101 can detect the leakage of hazardous gas with high concentration or with low concentration. Thus, there are two kinds of alarm signal generated by the transmitting end processor 102, which correspond to the above-mentioned leakage of dangerous gas with high concentration and with low concentrations respectively.

The structure in FIG. 4 shows a case which has two alarm signals. As shown in FIG. 4, in addition to the transmitting end microprocessor 301, the first divider resistor R1, the second divider resistor R2, and the controlled switch JK1 as connected mentioned above, the transmitting end processor 102 further comprise a third divider resistor R3, a fourth divider resistor R4 and a second controlled switch JK2. Wherein, the third divider resistor R3 have a fifth end and a sixth end, and the fourth divider resistor R4 have a seventh end and a eighth end. The divider resistor R3 is connected to the fourth divider resistor R4 in series. The sixth end mentioned above is connected to the seventh end, wherein the connection point is point b of FIG. 3. The connection point b is also connected to the other signal input terminal of the transmitting end microprocessor 301. Further, the fifth end is also connected to the output terminal of the transmitting end power supply 104. Both ends of the controlled switch JK2 are connected to the eighth end and the ground respectively. The opening and closing of the second controlled switch JK2 is also controlled by detector 101. Thus, when the detector 101 detected the leakage of dangerous gas with low concentration, it will control the first controlled switch JK1 to be closed while leaving the second controlled switch JK2 open. Thus, when a point is in the low level state while the point b is in the high level state, the transmitting end microprocessor 301 will send a first alarm signal to each of the receiving ends 12 through the radio transmitter 103 connected therewith, so that the carriers of the receiving ends 12 will know that there exits a leakage of hazardous gas with low concentration. Similarly, when the detector 101 detected the leakage of dangerous gas with high concentration, it will control the second controlled switch JK2 to be closed while leaving the first controlled switch JK1 open. Thus, when b point is in the low level state while the point a is in the high level state, the transmitting end microprocessor 301 will send a second alarm signal to each of the receiving end 12 through the radio transmitter 103 connected therewith, so that the carriers of the receiving ends 12 will know that there exits a leakage of hazardous gas with high concentration.

According to one embodiment of the invention, the transmitting end processor 102 also may includes more divider resistors and controlled switches, to adapt to the needs of the detection content and the detection accuracy of the detector 101 in a more complex situation.

The transmitting end power supply 104 may be utility power supply, a battery or a storage battery and the like. However, since the receiving end power supply 109 is always located at the receiving end 12, and if the receiving terminals 12 are carried by each individual worker, the receiving end power supply 109 is batteries or storage batteries due to the workers need to frequently change duty positions.

Figure 5:
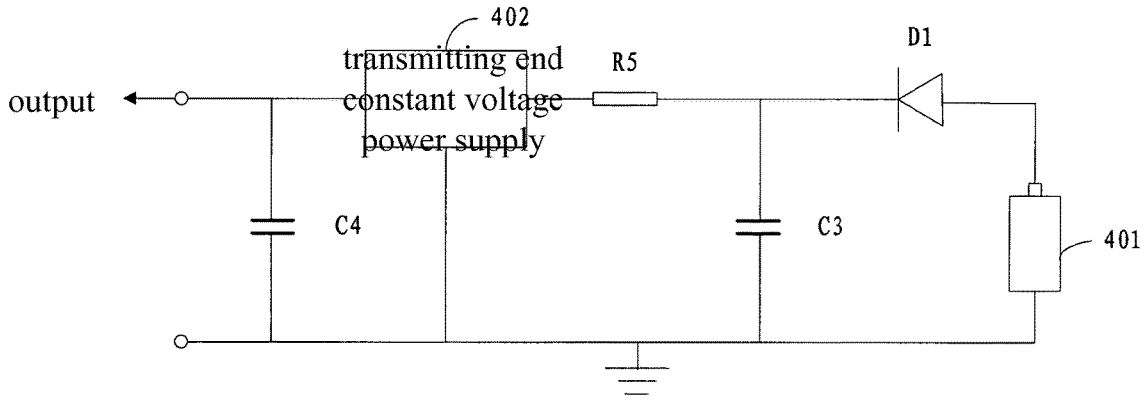
FIG. 5 is the structural view of a receiving end power supply according to an embodiment of the invention.

FIG. 5 is the structural view of the receiving end power supply of the invention.

As shown in FIG. 5, the receiving end power supply comprises: a battery 401, a diode D1, a current limiting resistor R5, a third rectifier filter capacitor C3, a fourth rectifier filter capacitor C4 and a receiving end constant voltage power supply 402 which outputs a predetermined constant DC voltage. Wherein, battery 401 can be assumed as button batteries, storage batteries, D battery, AA batteries, AAA batteries and the like. In order to guarantee an adequate supply of electricity, the battery 401 can be assumed as multiple batteries in series or in parallel.

As shown in FIG. 5, the diodes D1 and the third rectifier filter capacitor C3 can rectifies and filters the output voltage of the battery 401, thus the positive electrode and the negative electrode of the battery 401 are connected to the positive electrode and the ground of the diode D1 respectively, both ends of the third rectifier filter capacitor C3 being connected to the negative electrode and the ground of diode D1 respectively.

The current limiting resistor R5 is used to limit the current of the input voltage of the receiving end constant voltage power supply 402, and both ends of the current limiting resistor R5 are connected to the negative electrode of diode D1 and the input terminal of the receiving end constant voltage power supply 402 respectively.

The fourth rectifier filter capacitor C4 is used to rectify and filter the output voltage of the receiving end constant voltage power supply 402 and both ends of the fourth rectifier filter capacitor C4 are connected to the output terminal of the receiving end constant voltage power supply 402 and the ground respectively.

Here, the receiving end constant voltage power supply 402 is a device which converts the input voltage into a constant DC voltage output with predetermined value, the value of its output voltage has no relationship with the output voltage of the transmitting end constant voltage power supply 201 of FIG. 2. The output terminal of the receiving end constant voltage power supply 402 is the output terminal of the receiving end power supply 109 of the invention.

According to one embodiment of the invention, the function of receiving end 12 is to send an alarm to workers in time, and according to different application environments, a variety of forms of the alarm can be assumed, such as audible signal, visible signal, or vibration signal etc. According to different form of the alarm, the form of the alarms can be different, which will be described in the following.

Figure 6:
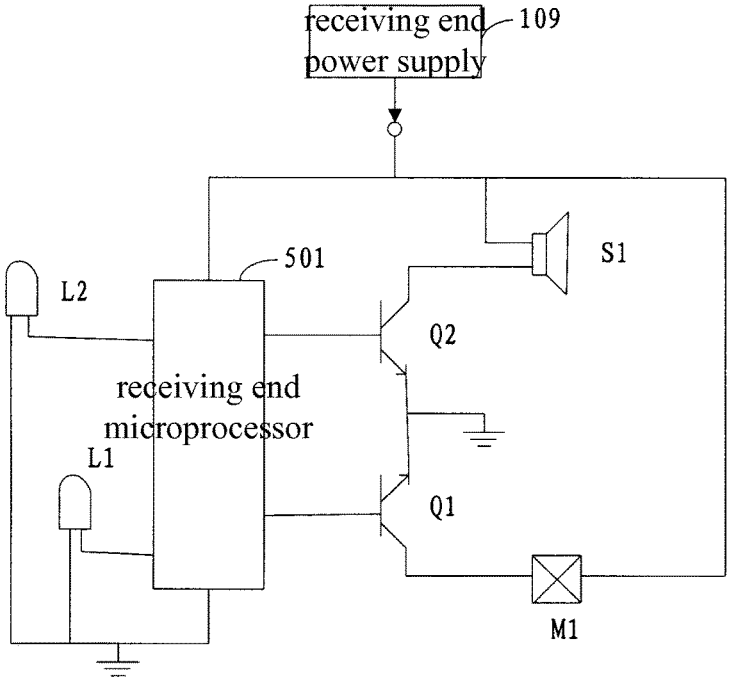
FIG. 6 is the structural view of a receiving end processor and an alarm according to an embodiment of the invention.

In the case that the alarm is vibration signal, the alarm 107 of FIG. 2 may be a vibration motor, and as shown in FIG. 6, the reference numeral of the vibrating motor is M1. In this case, the receiving end processor 106 of FIG. 2 includes a receiving end microprocessor 501 and a first triode Q1. Wherein, the base and the emitter of the first triode Q1 are connected to the control signal output terminal of the receiving end microprocessor 501 and the ground respectively. The positive electrode and the negative electrode of the vibration motor M1 are connected to the output terminal of the receiving end power supply 109 and the collector of the first triode Q1 respectively. Thus, when an alarm signal is received from the radio receiver 105, the receiving end microprocessor 501 may control the first triode Q1 to be turn-on, so as to start the vibration motor M1, so that the workers can feel the vibration of the vibration motor M1, and thus evacuate in time.

In the case that the alarm is an audible signal, the alarm 107 in FIG. 2 is the speaker S1 of FIG. 6. In this case, the receiving end processor 106 of FIG. 2 includes a receiving end microprocessor 501 and a second triode Q2. The base and the emitter of the second triode Q2 are connected to the control signal output terminal of the receiving end microprocessor 501 and the ground respectively; the positive electrode and the negative electrode of the speaker S1 are connected to the output terminal of the receiving end power supply 109 and the collector of the second triode Q2 respectively. Thus, when an alarm signal is received from the radio receiver 105, the receiving end microprocessor 501 may control the second triode Q2 to be turn-on, so as to start the speaker S1, so that the workers can hear an audible alarm emitted by the speaker S1, and thus evacuate in time.

In the case that the alarm is a visible signal, the alarm 107 of FIG. 2 may be implemented as the light-emitting diode L1 as shown in FIG. 6. In this case, the receiving end processor 106 in FIG. 2 includes a receiving end microprocessor 501. As shown in FIG. 6, two electrodes of the light-emitting diode L1 are connected to the control signal output terminal of the receiving end microprocessor 501 and the ground respectively. Thus, when an alarm signal is received from the radio receiver 105, the receiving end microprocessor 501 may control the light-emitting diode L1 to emit light, so that the workers can see the light emitted by the light-emitting diode L1, and evacuate in time.

Of course, in order to adapt to the detector 101 which has a variety of detection content and detection accuracy, here, the alarm 7 may be implemented as a plurality of alarm devices in parallel. As shown in FIG. 6, the alarm 107 can also includes a light emitting diode L2 in parallel with the light emitting diode L1, and the color of the light emitting diodes L1 and L2 is different, thus distinguishes different detection content and detection accuracy.

Similarly, the alarm 107 may also be assumed as many kinds of alarm devices in parallel. As shown in FIG. 6, the alarm 107 may be assumed as both the light emitting diode L1 and the vibration motor M1. In the event of a dangerous working condition, the alarm 107 sends a vibration signal and a visible signal simultaneously, thereby alerting at greatest extent the workers to evacuate.

According to one embodiment of the invention, the receiving end 12 may be located in the position of the helmet, arm, wrist, pocket, and other positions, and with each worker having one, which greatly improves the efficiency of warning for workers.

The present invention is designed to be explosion-proof products, suitable for II A, II B, II C Explosion-proof levels, and can operate in Zone 1 and Zone 2 of places where exist a combustible gas with temperature range of T1-T6 or an explosive mixture formed by vapor and air. Also, it can be widely used in place where combustible gas or toxic gas might be leaked out easily, such as refineries, chemical plants, metallurgy, pharmaceutical, and other places.

According to one embodiment of the invention, the alarm device of the invention may be used for high-altitude operations. For a mobile high-altitude operation machine, person below a moving object can not notice the object over them, so the alarm device may be provided on the helmets of the workers. When the object moved to the overhead of the worker, the worker will be alerted by the alarm device in time, thus preventing any injury or death caused by the dropping of the high-altitude object.

Figure 7:
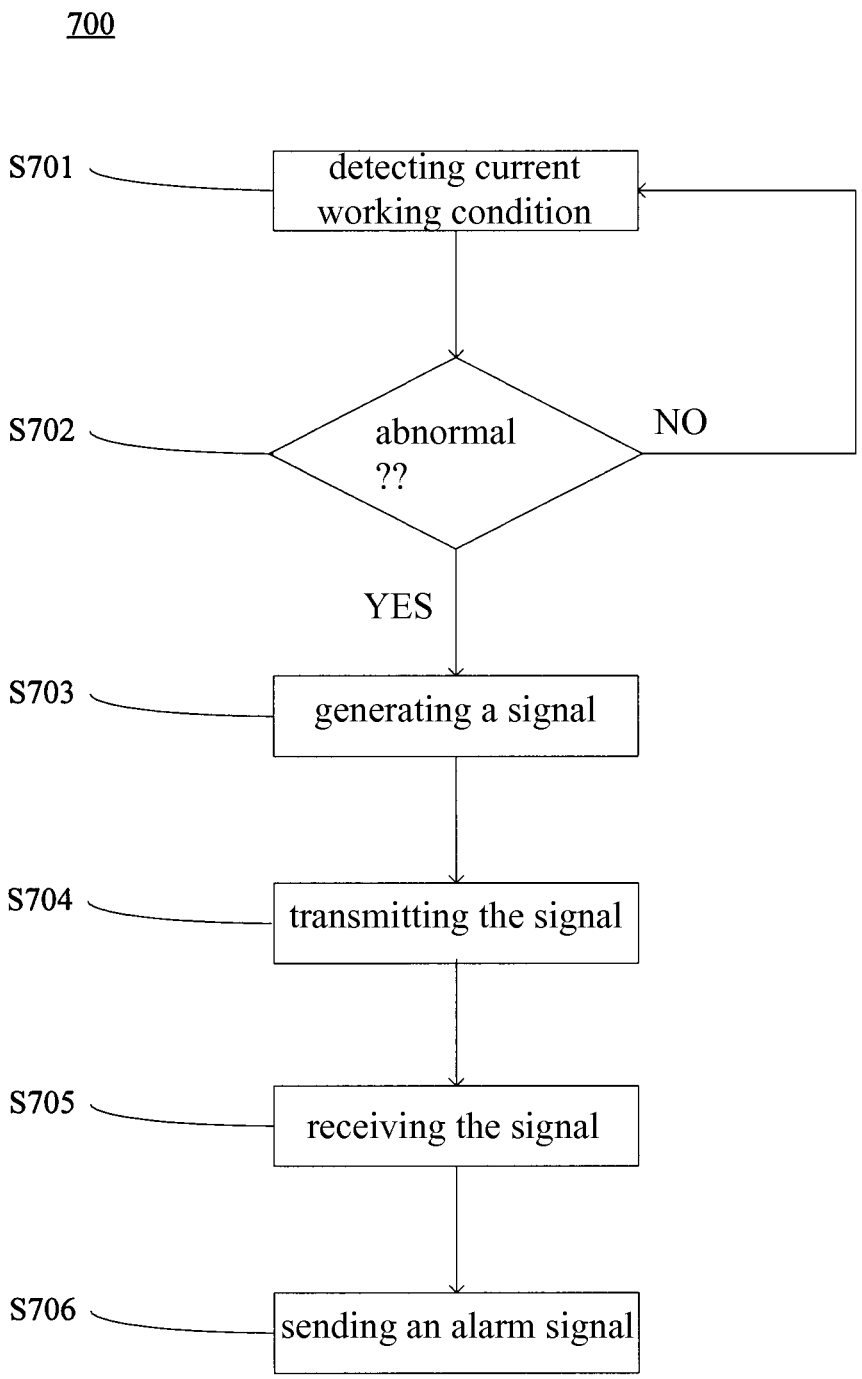
FIG. 7 is the flow chart of the real-time alarm method according to an embodiment of the invention.

FIG. 7 is the flow chart 700 of the real-time alarm method according to an embodiment of the invention.

In the step S701, at least one detecting device detects the current working condition. If at least one detecting device detected an abnormal current working condition in the step S702, it turns to step S703.

In the step S703, when at least one detecting device detected an abnormal current working condition, a relevant signal is generated.

In the step S704, the relevant signal is sent by at least a transmitting device. And in the step S705, the relevant signal transmitted by the transmitting device is received by at least one portable receiving device, and an alarm signal is sent in the step S706 at the same time.

According to one embodiment of the invention, in the step S704, the relevant signal is sent wirelessly by a transmitting device. And in the step S705, the relevant signal is received by a portable receiving device.

According to one embodiment of the invention, the current working condition detected in the step S701 may be temperature working condition, pressure working condition, gas working condition or a combination thereof.

According to one embodiment of the invention, the alarm signal sent in the step S706 may be audible signal, visible signal, vibration signal or a combination thereof.

The embodiments described above are the preferred embodiments of the present invention only, and not intended to limit the present invention, all the modifications, equivalent substitutions, improvements according to the spirit and principle of the present invention should be included in the scope of the invention.

The invention claimed is:

1. An industrial field real-time working condition radio alarm system, comprising:

a transmitting end and a receiving end carried by workers;

said transmitting end comprises:

a detector to detect the current working condition, a transmitting end processor to process an on-off signal sent by said detector, and a radio transmitter to transmit an alarm signal to said receiving end under the control of said transmitting end processor;

said receiving end comprises:

a radio receiver to receive said alarm signal, a receiving end processor to process said alarm signal sent by said radio receiver, and an alarm to send an alarm signal under the control of said receiving end processor;

wherein said transmitting end processor is connected to said detector and said radio transmitter respectively; and said receiving end processor is connected to said radio receiver and said alarm respectively;

said transmitting end further comprises:

a transmitting end power supply which is connected to said detector, said transmitting end processor, and said radio transmitter respectively;

said transmitting end processor comprises:

a transmitting end microprocessor, a first divider resistor, a second divider resistor, and a first controlled switch which is opened and closed under the control of said detector;

wherein said first divider resistor has a first end and a second end, and the second divider resistor has a third end and a fourth end;

said second end and said third end are connected to each other, and the connection point is connected to the signal input terminal of said transmitting end microprocessor;

both ends of said first controlled switch are connected to said fourth end and the ground respectively; and both of said voltage input terminal of said transmitting end microprocessor and said first end are connected to said output terminal of said transmitting end power supply.

2. The system as claimed in claim 1, wherein, said transmitting end power supply comprises:

a first rectifier filter capacitor, a second rectifier filter capacitor, a transmitting end constant voltage power supply which outputs a constant DC voltage; wherein, both ends of said second rectifier filter capacitor are connected to an external power supply and the ground respectively; the input terminal of said transmitting end constant voltage power supply is connected to the external power supply, and the output terminal of said transmitting end constant voltage power supply be used as the output terminal of the transmitting end power supply;

both ends of said first rectifier filter capacitor are connected to the output terminal of said transmitting end constant voltage power supply and the ground respectively.

3. The system as claimed in claim 1, wherein, said receiving end further includes a display connected to said receiving end processor.

4. The system as claimed in claim 1, wherein, said receiving end further includes a receiving end power supply connected to said radio receiver, said receiving end processor, said alarm respectively.

5. The system as claimed in claim 4, wherein, said receiving end power supply comprises:

a battery, a diode, a current limiting resistor, a third rectifier filter capacitor, a fourth rectifier filter capacitor and a receiving end constant voltage power supply which outputs a constant DC voltage; wherein, the positive electrode and the negative electrode of said battery are connected to the positive electrode of said diode and the ground respectively; both ends of said third rectifier filter capacitor are connected to the negative electrode of said diode and the ground respectively;

both ends of said current limiting resistor are connected to the negative electrode of said diode and the input terminal of said receiving end constant voltage power supply respectively;

both ends of said fourth rectifier filter capacitor are connected to the output terminal of said receiving end constant voltage power supply and the ground respectively;

the output terminal of said receiving end constant voltage power supply is the output terminal of the receiving end power supply.

6. The system as claimed in claim 4, wherein, said alarm is a vibration motor; said receiving end processor includes a receiving end microprocessor and a first triode; wherein, the base and the emitter of said first triode are connected to the control signal output terminal of said receiving end microprocessor and the ground respectively;

the positive electrode and the negative electrode of said vibration motor are connected to the output terminal of said receiving end power supply and the collector of said first triode respectively.

7. The system as claimed in claim 4, wherein, said alarm is a speaker; said receiving end processor includes a receiving end microprocessor and a second triode; wherein, the base and the emitter of said second triode are connected to the control signal output terminal of said receiving end microprocessor and the ground respectively;

the positive electrode and the negative electrode of said speaker are connected to the output terminal of said receiving end power supply and the collector of said second triode respectively.

8. The system as claimed in claim 4, wherein, said alarm is a light-emitting diode; said receiving end processor includes a receiving end microprocessor;

the two electrodes of said light-emitting diode are connected to the control signal output terminal of said receiving end microprocessor and the ground respectively.

9. A real-time alarm system, comprising a detecting device to detect whether the current working condition is abnormal or not, and generate relevant signals;

a transmitting device to transmit said relevant signals; and a portable receiving device to receive said relevant signal sent by said transmitting device and send an alarm signal, said transmitting device further comprises:

a transmitting end power supply connected to said detecting device, a transmitting end processor, and a transmitter respectively;

said transmitting end processor comprises:

a transmitting end microprocessor, a first divider resistor, a second divider resistor, and a first controlled switch which is opened and closed under the control of said detecting device;

wherein said first divider resistor has a first end and a second end, and the second divider resistor has a third end and a fourth end;

said second end and said third end are connected to each other, and the connection point is connected to the signal input terminal of said transmitting end microprocessor;

both ends of said first controlled switch are connected to said fourth end and the ground respectively; and both of said voltage input terminal of said transmitting end microprocessor and said first end are connected to said output terminal of said transmitting end power supply.

10. The alarm system as claimed in claim 9, wherein, said transmitting device may be radio transmitting device and said portable receiving device may be a radio receiving device.

11. The alarm system as claimed in claim 10, wherein, said portable receiving device can be carried by the workers.

12. The alarm system as claimed in claim 9, wherein, said detecting device may comprise:

a sensing unit to detect whether the current working condition is abnormal or not, and generate a signal relevant with the abnormal working condition;

a processing unit to process said signal relevant with the abnormal working condition and generate said relevant signal.

13. The alarm system as claimed in claim 12, wherein, said sensing unit may be a temperature sensor, a pressure sensor, a gas sensor or a combination thereof.

14. The alarm system as claimed in claim 9, wherein, said portable receiving device may comprise:

a receiving unit to receive the relevant signal sent by said transmitting device; and an alarm unit to send an alarm signal when the receiving unit received said relevant signal.

15. The alarm system as claimed in claim 14, wherein, said alarm unit may be an audible alarm, a visible alarm, a vibration signal or a combination thereof.

16. The alarm system as claimed in claim 9, wherein, said portable receiving device may be a mobile phone, personal computer or personal digital assistant.

17. The alarm system as claimed in claim 9, wherein, the number of said detecting device, said transmitting device or said portable receiving device may be one or more than one.

18. A real-time alarm method for a real-time alarm system, the system including a detecting device; a transmitting device; and a portable receiving device, said transmitting device including a transmitting end power supply connected to said detecting device, a transmitting end processor, and a transmitter respectively; said transmitting end processor including a transmitting end microprocessor, a first divider resistor, a second divider resistor, and a first controlled switch which is opened and closed under the control of said detecting device; said first divider resistor having a first end and a second end, and the second divider resistor has a third end and a fourth end; said second end and said third end being connected to each other, and the connection point being connected to the signal input terminal of said transmitting end microprocessor; both ends of said first controlled switch being connected to said fourth end and the ground respectively; and both of said voltage input terminal of said transmitting end microprocessor and said first end being connected to said output terminal of said transmitting end power supply, the method comprising:

detecting whether the current working condition is abnormal or not by said detecting device;

generating a relevant signal when the current working condition is abnormal by said detecting device;

transmitting said relevant signal by said transmitting device;

receiving said relevant signal through said portable receiving device; and sending an alarm signal when receiving said relevant signal by said portable receiving device.

19. The method as claimed in claim 18, wherein, said relevant signal is transmitted by a radio transmitting device, and said portable receiving device receiving wirelessly said relevant signal.

20. The method as claimed in claim 18, wherein, said current working condition may be temperature working condition, pressure working condition, gas working condition or a combination thereof.

21. The method as claimed in claim 18, wherein, said alarm signal may be audible signal, visible signal, vibration signal or a combination thereof.

* * * * *